US007393371B2

(12) United States Patent
O'Gary et al.

(10) Patent No.: US 7,393,371 B2
(45) Date of Patent: Jul. 1, 2008

(54) NONWOVEN ABRASIVE ARTICLES AND METHODS

(75) Inventors: Lucas M. O'Gary, Fargo, ND (US); David R. Brown, Hudson, WI (US); Scott M. Fabozzi, Lino Lakes, MN (US); Robert J. Maki, Hudson, WI (US); Lawrence J. Mann, Lake Elmo, MN (US); Louis S. Moren, Mahtomedi, MN (US); Randy L. Moseng, Hugo, MN (US); Kim C. Sachs, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 70 days.

(21) Appl. No.: 10/823,136

(22) Filed: Apr. 13, 2004

(65) Prior Publication Data

US 2005/0223649 A1 Oct. 13, 2005

(51) Int. Cl.
*B24D 3/00* (2006.01)
*B24D 11/00* (2006.01)
*B24D 18/00* (2006.01)

(52) U.S. Cl. ..... 51/297; 51/307; 51/308; 51/309; 51/295; 51/298; 51/293

(58) Field of Classification Search ..... 51/307, 51/308, 309, 295, 297, 298, 293
See application file for complete search history.

(56) References Cited

U.S. PATENT DOCUMENTS 2,958,593 A 11/1960 Hoover et al.
3,616,157 A * 10/1971 Smith ..... 428/171
4,314,827 A 2/1982 Leitheiser et al.
4,623,364 A 11/1986 Cottringer et al.
4,744,802 A 5/1988 Schwabel
4,770,671 A 9/1988 Monroe et al.
4,881,951 A 11/1989 Monroe et al.
4,888,091 A * 12/1989 Nollen et al. ..... 162/109
4,964,883 A 10/1990 Morris et al.
5,009,676 A 4/1991 Rue et al.
5,011,508 A 4/1991 Wald et al.
5,164,348 A 11/1992 Wood
5,185,012 A 2/1993 Kelly
5,219,462 A 6/1993 Bruxvoort et al.
5,244,477 A 9/1993 Rue et al.
5,354,591 A 10/1994 Ott et al.
5,372,620 A 12/1994 Rowse et al.
5,500,273 A 3/1996 Holmes et al.
5,620,545 A 4/1997 Braun et al.
5,626,639 A * 5/1997 King ..... 51/297
5,674,122 A 10/1997 Krech
5,753,343 A 5/1998 Braun et al.
5,766,277 A * 6/1998 DeVoe et al. ..... 51/295
5,820,450 A 10/1998 Calhoun
5,928,070 A * 7/1999 Lux ..... 451/526
6,197,076 B1 * 3/2001 Braunschweig et al. ..... 51/297
6,364,747 B1 * 4/2002 Gagliardi ..... 451/28
6,371,842 B1 4/2002 Romero
2002/0116876 A1 8/2002 Suzuki et al.
2003/0171051 A1 * 9/2003 Bergsten et al. ..... 442/327

FOREIGN PATENT DOCUMENTS

JP 2000289132 * 10/2000

* cited by examiner

*Primary Examiner*—Michael A Marcheschi

(57) ABSTRACT

Nonwoven abrasive articles, particularly lofty nonwoven abrasive articles, with a textured, non-planar surface and an abrasive coating thereon. The coating may cover the entire surface or only portions of the surface. The textured surface, composed of peaks or high regions and valleys or recessed regions, provides improved cut performance over nonwoven abrasive articles having a generally planar abrading surface.

32 Claims, 3 Drawing Sheets

NONWOVEN ABRASIVE ARTICLES AND METHODS

FIELD OF THE INVENTION

This invention is directed to textured abrasive articles, which comprise a lofty nonwoven substrate with an abrasive coating thereon.

BACKGROUND OF THE INVENTION

Nonwoven abrasive products are generally made by applying an abrasive coating to a nonwoven substrate and curing the abrasive coating. Suitable nonwoven substrates may be provided by processes such as carded, air laid, spunbond, or wet laid processes. Nonwoven substrates may be needle-tacked to densify and mechanically-entangle constituent fibers. Initial "prebond" coatings may be applied and cured to stabilize the nonwoven substrate prior to further processing. Abrasive coatings or layers, which include a curable (hardenable) binder and abrasive particles, are applied to the nonwoven substrate to form the abrasive product.

Low density abrasive products of the type defined in U.S. Pat. No. 2,958,593 and sold under the registered trademark "SCOTCH-BRITE" by 3M Company of St. Paul, Minn., have found significant commercial success as surface treatment products. This type of abrasive product is typically formed of crimped staple fibers which have been formed into a mat and impregnated with resinous binder and abrasive. This material is made available commercially in a wide variety of types to provide many functions.

Common forms for nonwoven abrasive products are a disc or wheel for mounting on a rotating axis, a belt, a pad for finishing equipment, such as floor treating pads or a sheet for use as a hand pad. The abrasive article may be attached to a support during use, such as a back-up pad for a grinder, or, the abrasive article may include sufficient volume to use as a hand pad.

In certain applications, nonwoven abrasive discs are preferred over coated abrasive discs, which generally have a cloth, paper or plastic backing, because the nonwoven discs are more conformable to the surface being finished. For example a nonwoven abrasive disc easily conforms around sharp corners and welds without tearing the disc or gouging the surface being finished. This conformability has its disadvantages for some applications, as the nonwoven discs usually have lower grinding characteristics (e.g., cut rate) than coated abrasive discs.

What is desired are nonwoven abrasive articles that retain the conformable aspects of nonwoven abrasive articles but have increased cut performance.

SUMMARY OF THE INVENTION

The present invention is directed to nonwoven abrasive articles, particularly lofty nonwoven abrasive articles, which have a textured, non-planar surface. The textured surface, composed of peaks or high regions and valleys or recessed regions, provides improved cut performance over nonwoven abrasive articles having a generally planar abrading surface. One common term for textured, non-planar is corrugated.

In one particular aspect, the invention is directed to a nonwoven abrasive article comprising a lofty nonwoven substrate having a first surface and an opposite second surface, and an abrasive coating comprising a binder and abrasive particles present on at least a portion of the first surface. The first surface and the second surface define a plurality of peaks and valleys. The nonwoven has a thickness, defined by the first surface and the second surface, the thickness being substantially constant throughout the substrate.

In another particular aspect, the invention is directed to a method of making a nonwoven abrasive article. The method include providing a lofty nonwoven substrate having a first surface and an opposite second surface, and providing an abrasive coating comprising a binder and abrasive particles on at least a portion of the first surface of the lofty nonwoven substrate. The first surface and the second surface of the nonwoven substrate define a plurality of peaks and valleys. The nonwoven has a thickness, defined by the first surface and the second surface, the thickness being substantially constant throughout the substrate.

DETAILED DESCRIPTION OF THE PREFERRED EMBODIMENT

The present invention relates, in general, to an abrasive article having a lofty nonwoven material as the carrier substrate for an abrasive coating. The topography of the abrasive article is three-dimensional, and has an abrading surface that includes a number of peaks or raised regions separated by valleys or recessed regions. The abrasive coating may be present across the entire surface of the lofty nonwoven substrate or limited to the peaks or to the valleys. The abrasive coating may be present on either or both sides of the abrasive article.

These and other beneficial features of the inventive abrasive article, as well as methods of making and using such an abrasive article, are described in greater detail below.

Figure 1:
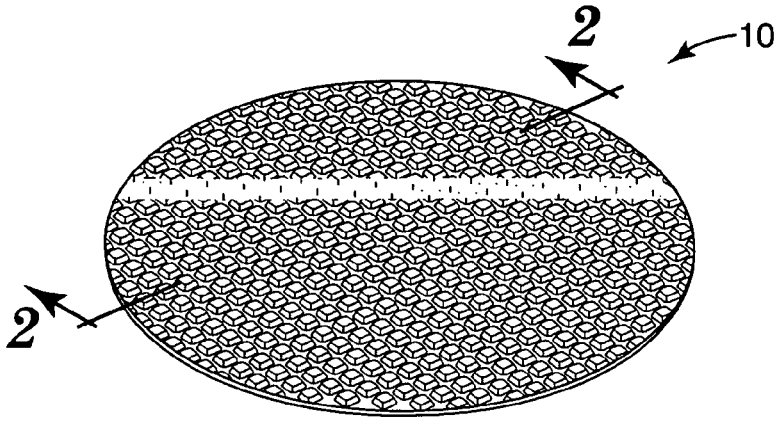
FIG. 1 is a perspective view of an abrasive article according to the invention.

Referring to the figures, an abrasive article according to the invention is illustrated in FIG. 1 at reference numeral 10. FIGS. 2-7 show various embodiments of abrasive article 10. Each abrasive article has a unique reference numeral (i.e., abrasive article 10A in FIG. 2, abrasive article 10B in FIG. 3, etc.), however, like features in the various embodiments are designated with the same reference numeral.

Figure 2:
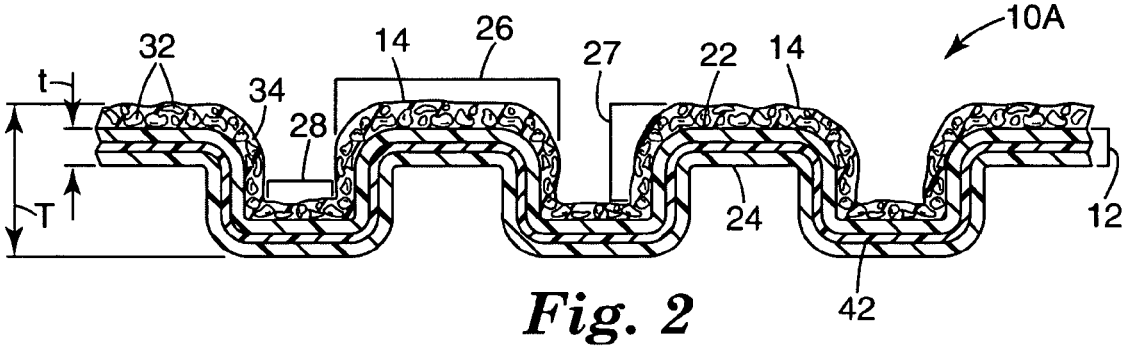
FIG. 2 is a cross-sectional view of a first embodiment of an abrasive article according to the invention, taken along line 2-2 of FIG. 1.

As seen in FIG. 2, abrasive article 10A has a substrate 12 supporting an abrasive coating 14. Substrate 12 is defined between a first surface 22 and an opposite, second surface 24.

Substrate 12 has a plurality of peaks or raised regions 26 and a plurality of valleys or recessed regions 28. Each surface 22, 24 includes sidewall portions 27 which extend from peaks 26 to valleys 28.

Second surface 24 follows the contours of first surface 22, thus creating a substrate with an essentially constant thickness. The thickness "t" of substrate 12 varies no more than 50% across substrate 12, typically no more than 30%. A thickness variation of no more than 20% is preferred. Having such a substrate 12, with first surface 22 being the inverse of second surface 24, allows for applying abrasive coating 14 on either or both of surfaces 22, 24 and still obtaining a textured abrasive surface. Additionally, having a substrate 12, with an essentially constant thickness, provides an abrasive article with a consistent surface for supporting an abrasive coating and provides an abrasive article with a consistent thickness, which provides consistent grinding or polishing results.

Abrasive coating 14 has a plurality of abrasive particles 32 retained on first surface 22 of substrate 12 by a binder 34. Abrasive particles 32 may be distributed throughout binder 34 or may be generally present as a layer retained by binder 34.

Figure 3:
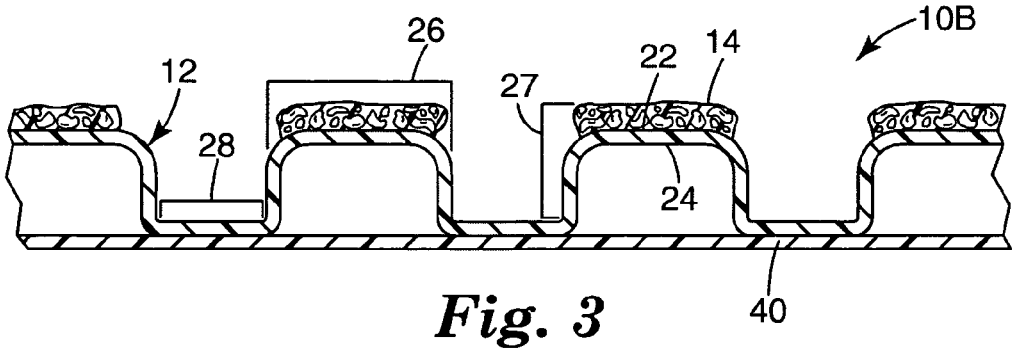
FIG. 3 is a cross-sectional view of a second embodiment of an abrasive article according to the invention, taken along line 2-2 of FIG. 1.
Figure 4:
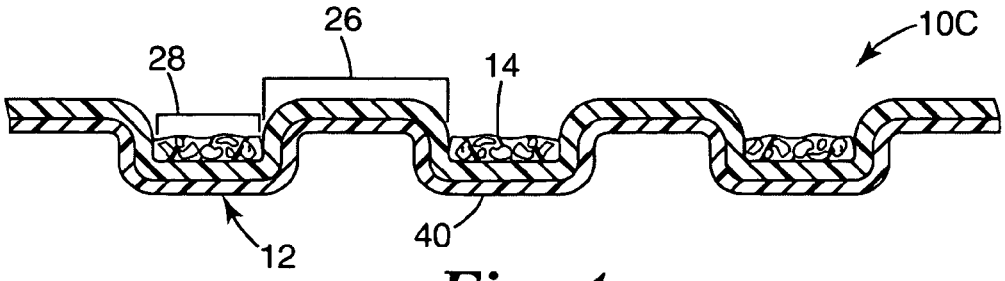
FIG. 4 is a cross-sectional view of a third embodiment of an abrasive article according to the invention, taken along line 2-2 of FIG. 1.
Figure 5:
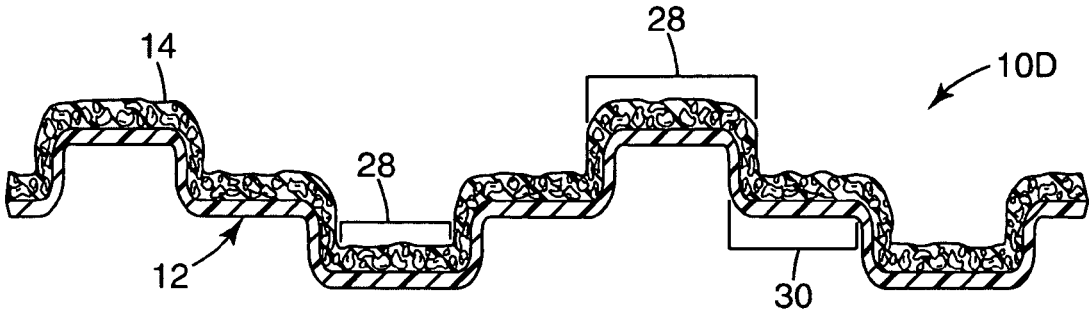
FIG. 5 is a cross-sectional view of a fourth embodiment of an abrasive article according to the invention, taken along line 2-2 of FIG. 1.

Abrasive article 10A has abrasive coating 14 present on peaks 26 and in valleys 28, and on sidewall portions 27 connecting peaks 26 with valleys 28. Variations of abrasive coating 14 are illustrated in FIGS. 3-5. Abrasive article 10B, of FIG. 3, is similar to abrasive article 10A of FIG. 2 except that abrasive article 10B has abrasive coating 14 present on peaks 26 but not in valleys 28 or on sidewalls 27. Abrasive article 10C, of FIG. 4, is similar to abrasive article 10A of FIG. 2 except that abrasive article 10C has abrasive coating 14 in valleys 28 but not on peaks 26. Abrasive article 10D, in FIG. 5, differs from the previous abrasive articles 10A, 10B, 10C, due to the lofty nonwoven substrate 12. The substrate of abrasive article 10D includes peaks 26, valleys 28, and land portions 30 connecting peaks 26 and valleys 28. Land portions 30 are an intermediate elevation between peaks 26 and valleys 28.

Figure 6:
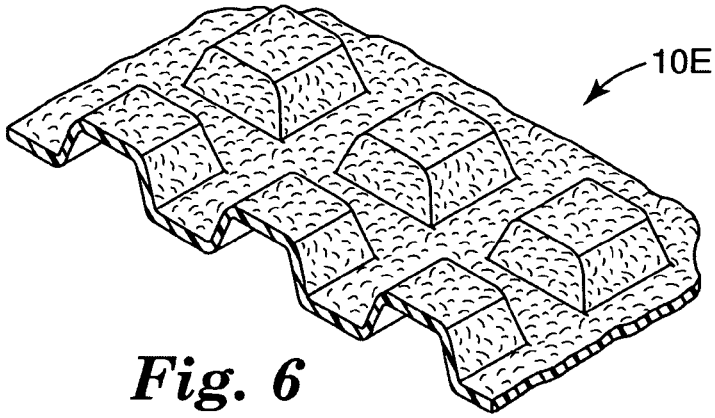
FIG. 6 is a perspective view of a fifth embodiment of an abrasive article according to the invention.
Figure 7:
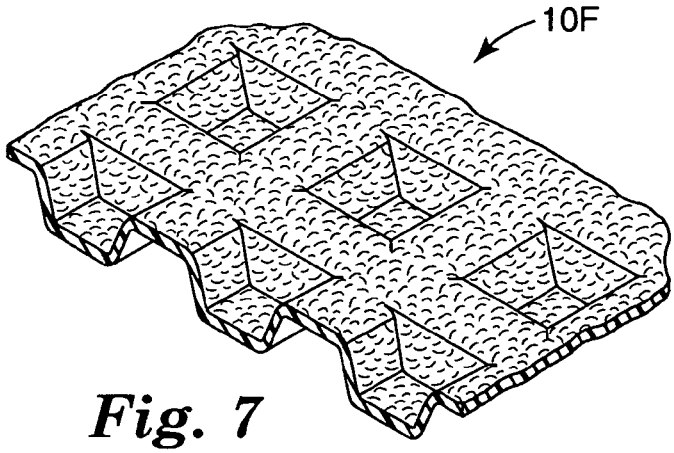
FIG. 7 is a perspective view of a sixth embodiment of an abrasive article according to the invention.

FIGS. 6 and 7 illustrate two different embodiments of abrasive articles having a substrate with the same configuration, but the abrasive coating being on opposite sides of the substrate. For both abrasive article 10E (FIG. 6) and abrasive article 10F (FIG. 7), the substrate has a plurality of valleys and peaks, with the abrasive coating present across the entire substrate. Abrasive article 10E, in FIG. 6, has individual peaks and interconnected valleys, with the abrasive coating present in both the peaks and valleys; the peaks resemble "pillows". In an alternate embodiment of abrasive article 10E, the abrasive coating could be present predominantly on the peaks or "pillows" of the lofty nonwoven substrate. Abrasive article 10F, in FIG. 7, has individual valleys and interconnected peaks; the valleys resemble "pockets". In an alternative embodiment of abrasive article 10F, the abrasive coating could be present predominantly in the "pockets" of the lofty nonwoven substrate.

In the embodiments of FIGS. 2-7, and best seen in FIGS. 6 and 7, the abrasive articles have a topography composed of peaks 26 and valleys 28 present as a rectilinear grid. That is, peaks 26 and valleys 28 are present across the width and the length of the abrasive article. Unlike those embodiments, abrasive article 10G of FIG. 8 has extended lengths of peaks 26 and valleys 28.

Abrasive article 10 et seq. has an overall thickness, measured from the outer edge of abrasive article 10 to the outer most, opposite surface of article 10. In FIG. 2, thickness "T" is illustrated as being defined as the distance from the outer surface of abrasive coating 14 to the outer surface defined by second surface 24 of substrate 12. In FIGS. 3 and 4, where an additional substrate is present (as will be discussed in detail below), the thickness is defined as the distance from outer surface defined by the second substrate to the opposite surface, either the outer surface of abrasive coating 14 (FIG. 3) or the top of peak 26 (FIG. 4). Generally, the thickness of abrasive article 10 et seq. is at least 3 mm, usually at least 3.175 mm (⅛ inch), and often at least 6.35 mm (¼ inch).

Various features of the abrasive articles are discussed below.

Substrate

Substrate 12 of abrasive article 10 et seq. is a lofty nonwoven, fibrous material. By use of the term "lofty nonwoven", what is intended is a layer of nonwoven web material composed of a plurality of randomly oriented fibers, the layer having a thickness (prior to corrugation) of at least 150 micrometers, usually at least 500 micrometers (0.5 mm). In most embodiments, lofty nonwoven substrate 12 is at least 3.175 mm (⅛ inch) thick. Common thicknesses for substrate 12 are, for example, 6.35 mm (¼ inch) and 12.7 mm (½ inch). Addition of a prebond binder onto the fibrous mat does not significantly alter the thickness of the substrate. The lofty nonwoven may decrease in thickness due to the pressure applied to the nonwoven during the corrugation process. The corrugated substrate 12 will retain least 35%, and preferably at least 50% of its original thickness compared to the nonwoven substrate prior to corrugating. It is not unexpected that a thicker nonwoven material will decrease more in thickness than a thinner nonwoven. The thickness of substrate 12, "t" from surface 22 to surface 24, after corrugation, is at least 150 micrometers, usually at least 500 micrometers. In most embodiments, the thickness is at least 1000 micrometers (1 mm), and a preferred range is 1 mm to 15 mm. Typically, the thickness is no greater than 2 cm, often no greater than 1.5 cm. Common thicknesses for corrugated substrate 12 include 3.4 mm and 6.5 mm.

Preferred components for the lofty nonwoven substrate 12 include nonwoven webs made from one or more of a variety of thermoplastic polymers that are known to form fibers. Suitable thermoplastic polymers can be selected from polyolefins (such as polyethylenes, polypropylenes, and polybutylenes), polyamides (such as nylon 6, nylon 6/6, and nylon 10), polyesters (such as polyethylene terephthalate), copolymers containing acrylic monomers, and blends and copolymers thereof. Semi-synthetic fibers (such as acetate fibers), natural fibers (such as cotton), regenerated fibers (such as rayon), and other non-thermoplastic fibers can also be blended with the thermoplastic fibers.

The fibers typically have a denier of from about 6 to about 200, more usually about 50 to about 100. The basis weight of the lofty nonwoven substrate 12 (fibers only, with no prebond binder layer) is preferably from about 50 grams per square meter to about 1 kilogram per square meter, and more preferably from about 150 to about 600 grams per square meter. Typically, a prebond binder is applied to the lofty nonwoven substrate to lock the fibers. The basis weight of the lofty nonwoven substrate 12, with prebond binder, is usually from about 100 grams per square meter to about 2 kilogram per square meter, and more preferably from about 300 grams to about 1.5 kilogram per square meter. One particular suitable substrate 12, with prebond binder, has a basis weight of about 1.15 $kg/m^2$.

The lofty nonwoven substrate can be prepared by any suitable web forming operation. For example, the lofty nonwoven webs may be carded, spunbonded, spunlaced, melt blown, air laid, creped, or made by other processes as are known in the art.

Topography

Figure 8:
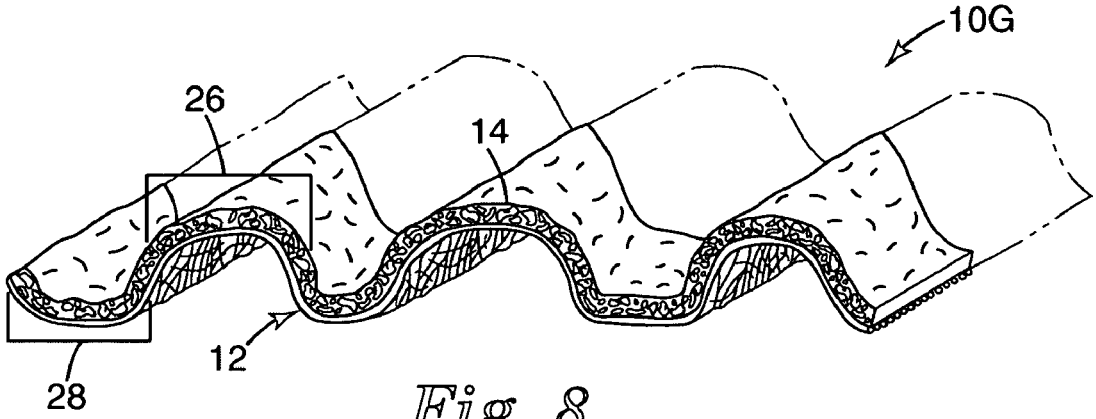
FIG. 8 is a cross-sectional view of a seventh embodiment of an abrasive article according to the invention, taken along line 2-2 of FIG. 1.

Substrate 12 has a three-dimensional topography present therein, thus providing a non-planar abrading surface for abrasive articles 10 et seq. Peaks 26 and valleys 28, which form the topography, are preferably provided in a regular pattern or array on substrate 12. For example, peaks or raised regions 26 can be provided as generally parallel continuous rows separated by valleys 28, as illustrated in FIG. 8. Alternatively, peaks or raised regions 26 can be separated by valleys 28 in a pattern, typically a rectilinear grid. Raised regions 26 and valleys 28 can be rectangular or square, or have other patterns and shapes including but not limited to diamonds, circles, ovals, triangles, tear drops, hexagons, and octagons. Peaks 26 and valleys 28 could be provided in what appears to be a random pattern, but because the peaks are normally formed by rollers or other devices that would periodically repeat the random pattern, this arrangement may actually be a repeating random pattern, or semi-random pattern.

The height of peaks 26 and depth of valleys 28 is defined by the distance of displacement of the substrate surface, either 22 or 24, from its non-corrugated state. The height of the peaks or depth of the valleys is also equal to the length of sidewall 27.

While the peaks and valleys may be of varying heights and depths, the height of peaks 26, or depth of valleys 28, is generally uniform and ranges from about 0.5 mm to about 5 mm, preferably from about 1.5 mm to about 4 mm. The height of peaks 26 for one particular embodiment is 2.2 mm to 3.5 mm. In another embodiment, the peaks have a height of at least 0.5 mm. For examples where peaks or raised regions 26 are separated by valleys 28 provided in a rectilinear grid, such as the embodiments shown in FIGS. 2-7 the surface area of the individual peaks or raised regions ranges from about 9 $mm^2$ to about 250 $mm^2$. For corrugated samples where peaks or raised regions 26 are provided as generally parallel continuous rows separated by valleys, such as those illustrated in FIG. 8, the surface area of peaks or raised regions 26 ranges from about 150 $mm^2$ to about 450 $mm^2$ (when measured for a section having a surface area of about 650 $mm^2$).

The peaks can occupy from about 25% of the area to about 75% of the area. The ratio of area occupied by peaks 26 and valleys 28 is usually within the range of 25:75 to 75:25, and in most embodiments is within the range of 40:60 to 60:40. As stated above, substrate 12 has a substantially constant thickness, with second surface 24 following first surface 22. A substrate having a 50:50 ratio of peak area 26 to valleys 28 is beneficial in that either surface 22, 24 can be coated and provide the same surface area of peaks 26 and valleys 28.

Backing or Scrim

The abrasive article may include a second substrate in addition to lofty nonwoven substrate 12. This second substrate may be a backing layer, present on the back side of the lofty nonwoven substrate, or may be a scrim or other layer present within the lofty nonwoven substrate. The second substrate may be included, for example, to stiffen the abrasive article, reduce stretching, provide improved tear resistance, provide an attachment mechanism, or to increase desired article properties (such as absorption). Various constructions of abrasive articles with second substrates are illustrated in FIGS. 2-4. FIGS. 3 and 4 illustrate a backing 40 present on second surface 24, and FIG. 2 illustrates a scrim 42, such as a reinforcing scrim, present within substrate 12 between first surface 22 and second surface 24. Preferably, second substrate 40, 42 is a permanent feature of abrasive article 10; that is, second substrate 40, 42 is not readily removable from substrate 12.

Second substrate 40, 42 can be a fairly thin material, having a thickness less than the thickness of substrate 12. Examples of thin materials include a knitted or woven fabric or cloth, a nonwoven web, a thermoplastic or other plastic film, paper, or laminates thereof. Usual thickness for such materials is 250 micrometers to 4 mm, although thicker and thinner materials would also be suitable. Other suitable materials include substrates having loops or hooks thereon, which are one half of an attachment system and are used to attach abrasive article 10 to a back-up pad or the like. Second substrate 40 can alternately be fairly thick, having a thickness greater than the thickness of substrate 12. For example, suitable thick second substrates 40 include sponges, which can be open cell or closed cell. Common sponge materials include cellulose and polyurethane. Usual thickness for such materials is 3.175 mm (⅛ inch) to 5.1 cm (2 inches) or more.

Referring to FIG. 3, one embodiment with second substrate 40 is illustrated. For abrasive article 10B, second substrate 40 is attached to second surface 24 at valleys 28 and not at peaks 26, on the side of substrate 12 opposite abrasive coating 14. In such a construction, second substrate 40 is attached to substrate 12 after the texture has been imparted to substrate 12.

Referring to FIG. 4, another embodiment with second substrate 40 is illustrated. Abrasive article 10C has second substrate 40 attached to second surface 24 at peaks 26 and valleys 28, on the side of substrate 12 opposite abrasive coating 14. In such a construction, second substrate 40 is attached to substrate 12 prior to or simultaneously to the texture being imparted to substrate 12. Thus, the texture is imparted to both substrate 12 and second substrate 40.

In FIG. 2, an embodiment of a scrim 42 is illustrated. Abrasive article 10A has second substrate 42 present within substrate 12, between first surface 22 and second surface 24. Scrim 42 may be positioned closer to one surface 22, 24 than the other, or, may be equally positioned therebetween. In such a construction, scrim 42 is positioned within substrate 12 prior to the texture being imparted to substrate 12. Scrim 42 may be positioned within substrate 12 during the manufacture of the lofty nonwoven material, or may be subsequently added, for example, by needle tacking. For embodiments where scrim 42 is needle tacked into substrate 12, scrim 42 is generally a woven or knitted mesh material.

In FIG. 3 and FIG. 4, an adhesive may be used to secure second substrate 40 to second surface 24, or, if one or both of substrate 12 and second substrate 40 comprises thermoplastic material, the material can be heated and melted to secure substrates 12, 40 together.

Methods of Corrugating Lofty Nonwoven Substrate

Figure 9:
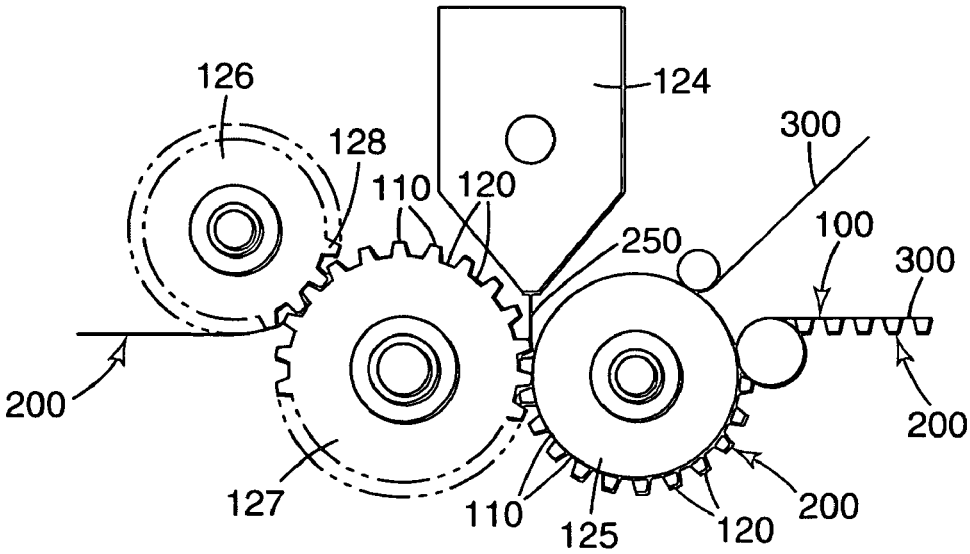
FIG. 9 is a schematic illustration of a process for making a substrate for use in an abrasive article of the present invention.

There are a number of suitable ways of making a corrugated lofty nonwoven substrate of the abrasive article of the present invention. FIG. 9 schematically illustrates a method and equipment for forming a lofty nonwoven substrate 12 suitable for use in the abrasive articles of FIGS. 2-8. The method illustrated in FIG. 9 generally includes forming a corrugated or textured substrate so that it has peaks or raised regions 26 and valleys or recessed regions 28. A second substrate is attached to one side of the textured substrate after the texture has been imparted.

In FIG. 9, a web of preformed, uncorrugated lofty nonwoven material 200 is used as the starting material in the illustrated process. This lofty nonwoven material 200 is fed between first and second corrugating members or rollers 126 and 127 each having an axis and including a plurality of circumferentially spaced generally axially extending ridges 128 around and defining its periphery, with spaces between ridges 128 adapted to receive portions of ridges 128 of the other corrugating member, 126 or 127, in meshing relationship with nonwoven web 200 between meshed ridges 128. One or both of corrugating members 126, 127 may be heated to facilitate the corrugation process; preferably, the heat is not so high that nonwoven material 200 appreciably melts, although some melting of fibers is acceptable. Corrugating members 126, 127 are mounted in axially parallel relationship with portions of ridges 128 meshing, generally in the manner of gear teeth. At least one of corrugating members 126, 127 is rotated, and nonwoven material 200 is fed between the meshed portions of ridges 128 of corrugating members 126, 127 to generally corrugate the nonwoven material 200. The corrugated nonwoven 200 is retained along the periphery of second corrugating member 127 after it has moved past the meshed portions of ridges 128.

In the process illustrated, a backing member, such as second substrate 40 of abrasive article 10B in FIG. 3 is applied to substrate 12.

An adhesive layer 250 is extruded from a die 124 into a nip formed between second corrugating member 127 and a flat surfaced cooling roller 125 while simultaneously supplying a backing member 300 into the nip between corrugating member 127 and cooling roller 125 along the surface of roller 125. This results in adhesive layer 250 being deposited between backing member 300 and nonwoven material 200, thus bonding backing member 300 and nonwoven material 200 along valley portions 110 and peak portions 120. The resulting nonwoven laminate 100 is then carried partially around the cooling roller 125 to complete cooling.

Alternatively, the substrates for abrasive article 10B could be formed by thermally or ultrasonically bonding backing member 300 to the corrugated nonwoven material.

The method and equipment used for forming abrasive article 10C of FIG. 4, having backing 40 laminated along the length of substrate 12 and following the peaks and valleys of substrate 12, is similar to and uses the same equipment illustrated in FIG. 9, except that instead of extruding an adhesive layer to bond backing member 300 onto nonwoven web 200, backing member 300 is formed and bonded to nonwoven web 200 prior to web 200 progressing between corrugating members 126, 127.

Abrasive Coating

Abrasive coating 14, supported by substrate 12, is composed of abrasive particles 32 retained onto substrate 12 by binder 34.

Abrasive Particles

Abrasive particles 32 may be organic or inorganic particles. Examples of suitable inorganic abrasive particles include alumina or aluminum oxide, (such as fused aluminum oxide, heat treated fused aluminum oxide, ceramic aluminum oxide, heat treated aluminum oxide), silicon carbide, titanium diboride, alumina zirconia, diamond, boron carbide, ceria, aluminum silicates, cubic boron nitride, garnet, silica, and combinations thereof. Preferred fused aluminum oxides include those available commercially pretreated by Exolon ESK Company, Tonawanda, N.Y., or Washington Mills Electro Minerals Corp. Preferred ceramic aluminum oxide abrasive particles include those described in U.S. Pat. Nos. 4,314,827; 4,623,364; 4,744,802; 4,770,671; 4,881,951; 4,964,883; 5,011,508; and 5,164,348, the contents of all of which are incorporated herein by reference. Other examples of particles useful for this invention include solid glass spheres, hollow glass spheres, calcium carbonate, polymeric bubbles, silica and silicates, aluminum trihydrate, mullite, and pumice.

Organic abrasive particles suitable for use in abrasive article are preferably formed from a thermoplastic polymer and/or a thermosetting polymer. Organic abrasive particles can be formed from a thermoplastic material such as polycarbonate, polyetherimide, polyester, polyvinyl chloride (PVC), polymethacrylate, polymethylmethacrylate, polyethylene, polysulfone, polystyrene, acrylonitrile-butadiene-styrene block copolymer, polypropylene, acetal polymers, polyurethanes, polyamide, and combinations thereof. The organic abrasive particle may be a mixture of a thermoplastic polymer and a thermosetting polymer.

A preferred organic abrasive particle is a metal and mold cleaning plastic blast media available commercially as "MC" blast media from Maxi Blast Inc., South Bend, Ind., available with an antistatic coating, but preferably untreated. The "MC" media is a 99% melamine formaldehyde condensate, an amino thermoset plastic.

The abrasive particles, either inorganic or organic, can have any precise shape or can be irregularly or randomly shaped. Examples of such three dimensional shapes includes: pyramids, cylinders, cones, spheres, blocks, cubes, polygons, and the like. Alternatively, the organic abrasive particles can be relatively flat and have a cross sectional shape such as a diamond, cross, circle, triangle, rectangle, square, oval, octagon, pentagon, hexagon, polygon and the like. Shaped abrasive particles, and methods of making them, are taught in U.S. Pat. Nos. 5,009,676; 5,185,012; 5,244,477; and 5,372,620, the contents of all of which are incorporated herein by reference. Shaped thermosetting organic abrasive particles can be made in accordance with U.S. Pat. No. 5,500,273, which is incorporated herein by reference.

The surface of the abrasive particles (a portion of their surface, or the entire surface) may be treated with coupling agents to enhance adhesion to and/or dispersibility in binder 34.

The average particle size of the abrasive particles for advantageous applications of the present invention is at least about 10 micrometers, usually at least about 50 micrometers, and preferably at least about 100 micrometers. A particle size of about 50 micrometers corresponds approximately to a coated abrasive grade 280 abrasive grain, according to American National Standards Institute (ANSI) Standard B74.18-1984, 100 micrometers to about grade 120, and 600 micrometers to about grade 30, all of which are suitable for abrasive articles according to the invention.

Abrasive particles 32 can be oriented within abrasive coating 14, or can be applied to substrate 12 without orientation, depending upon the desired end use of abrasive article 10.

Preparation of the Abrasive Articles

A variety of methods can be used to prepare abrasive articles 10 et seq. according to the present invention. Abrasive coating 14 can be applied to substrate 12 by conventional abrasive coating techniques.

Abrasive coating 14 may have abrasive particles 32 dispersed throughout binder 34. Such a coating is obtained by applying a slurry of abrasive particles 32 and liquid binder 34 to substrate 12 and then curing or otherwise hardening binder 34. A second binder layer which may or may not have additional abrasive particle included, often referred to as a size coat, may be applied over the slurry layer and hardened.

Another common abrasive coating 14 utilizes a make coat or a roll coat. Such a coating is obtained by applying a layer of liquid binder 34, usually by spraying or roll coating, to the substrate and then applying abrasive particles 32 thereon. Abrasive particles 32 may be merely dropped onto binder 34 or may be oriented, for example by an electrostatic field. Abrasive particles 32 are at least partially embedded into binder 34. After application of particles 32, binder 34 is cured or otherwise hardened. A second binder layer, often referred to as size coat, may be applied over the make or roll coat and hardened.

Binder

Binder 34 of abrasive coating 14 retains abrasive particles 32 onto substrate 12. Binder 34 is derived from a liquid binder or binder precursor, which comprises an organic polymerizable resin, which is hardened or cured to form binder 34. During the manufacture of abrasive articles 10, the binder precursor is exposed to an energy source which aids in the initiation of the polymerization or curing process. Examples of energy sources include thermal energy and radiation energy. During this polymerization process, the resin is polymerized and the binder precursor is converted into a solidified binder. Binder 34, when solidified, hardened or cured, is non-tacky.

Examples of organic resins suitable for binder 34 include phenolic resins (both resole and novolac), urea-formaldehyde resins, melamine formaldehyde resins, acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, mixtures and combinations thereof. Other materials not within these groups are also suitable as binder 34.

Methods of Using the Abrasive Article

Abrasive articles 10 of the invention may be used in any application that uses conventional nonwoven abrasive articles. Abrasive articles of this invention may be available as grinding discs, as endless belts, as sheets, as hand pads, and the like. The inventive abrasive articles would be used in the same manner as conventional articles.

EXAMPLES

Unless stated otherwise, the articles described in the Examples below were prepared utilizing a nonwoven prebond made according to the following procedure. All ratios, parts, percentage, etc. are provided in weight, unless specified otherwise.

A lofty nonwoven material, having a weight of 293 g/m$^2$, was prepared from 58 denier (64.5 dtex)×5.1 cm nylon staple fibers using an air lay Rando Weber machine (commercially available from the Rando Machine Company, Macedon, N.Y.). The thickness of this lofty nonwoven material was about 1.8 cm. The resulting nonwoven was placed on a 301 g/m$^2$ woven polyester scrim cloth ("101×43 Polyester Cloth Power Strate", obtained from Milliken & Co., Spartanburg, S.C.) and the two layers were passed through a needle-tacking machine (commercially available from Dilo, Inc. of Charlotte, N.C.) fitted with needle board comprised of 15×18×25×3.5 RB needles (commercially available from Foster Needle Company, Manitowoc, Wis.). The needle-tacking machine was operated at 600 strokes per minute, with a penetration depth of 13 mm, and at a rate of 6.1 m/min. The resultant nonwoven composite structure had about 55% of its thickness above the plane (top) defined by the polyester scrim cloth and about 45% below that plane (bottom). This composite was next passed through a pair of opposing rollers (having an outer diameter of 25.4 cm, or 10 inches) set at a pressure of about 1.75 kg/cm$^2$. The top roller was heated to and held at 174° C.

The needled composite was then impregnated with a prebond resin precursor by passing it through a two-roll coater to provide a dry add-on weight of about 556 g/m$^2$. The formulation of the prebond resin precursor is provided below.

| Component | weight % |
|---|---|
| 65% PMA/35% methylene dianiline | 17.24 |
| lithium stearate premix[1] | 4.38 |
| ADIPRENE BL-16[2] | 50.00 |
| Red Pigment | 1.93 |
| Calcium carbonate | 19.66 |
| PMA | 6.79 |

[1]41% dispersion of lithium stearate, commercially available from JLM Marketing Inc. of Tampa, FL, in POLYSOLV solvent, commercially available from Witco Corp., of Chicago, IL.
[2]Trade designation for a blocked polyfunctional isocyanate polymer from Uniroyal Chemical Company, Inc. of Middlebury, CT.

After being coated onto the nonwoven material, the prebond resin precursor was cured in a tunnel oven at 143° C. for a period of about 4 minutes. The cured nonwoven prebond web was slit into 12 inch wide rolls for further processing for use in the examples listed below.

Example 1

The lofty nonwoven web, described above, was corrugated by a process and equipment similar to that illustrated in FIG. 9 except that the first and second intermeshing patterned rollers (corrugating members 126 and 127, respectively) were machined with a diamond pattern. The diamonds were approximately 8 mm per side and there were approximately 9 diamonds per square inch (6.45 cm$^2$) with a space between each diamond. Both pattern rolls were heated to 232° C. The lofty nonwoven web was fed into the nip between the intermeshing patterned rollers such that the web first major surface was up. The resulting patterned nonwoven web had depressed regions or pockets on the first major surface of the web. Each pocket was about 3 mm deep.

An abrasive coating was applied to the first major surface of this patterned web.

The surface of the web was spray coated at a line speed of 5 feet/min. (1.5 m/min) with a resin/abrasive slurry using a spray gun ("BINKS SPRAY GUN #601") equipped with nozzle #59ASS and cap # 151 (all obtained from Midway Industrial Supply Co., St. Paul, Minn.). The spray was delivered to the spray gun utilizing a Bredel Hose Pump SP/15 (obtained from Powell Equipment Sales, Inc., Coon Rapids, Minn.). The spray gun was reciprocated across the web at 61 reciprocations per minute to provide a wet add-on weight of 293 grains/24 in$^2$ (1225 g/m$^2$).

The slurry was prepared by mixing together 10.8 lbs (4.9 kg) of phenolic resin (obtained from Neste Resins, Canada, under the trade designation BB077), 6.3 lb. (2.86 kg) of propylene glycol monomethyl ether (obtained from Dow Chemical, Midland, Mich.), 1.9 lb (0.86 kg) of Ace Lube (obtained from Lubrication Technologies, Inc. under the trade designation Ace-Lube 23N), 0.5 lb (0.23 kg) of bentonite clay (obtained from American Colloid Co. under the trade designation Volcay 325), 2.3 lb (1.04 kg) of Epicure 852 (obtained from Resolution Performance Products, Houston, Tex. under the trade designation Epi-Cure 3015), and 29.0 lb (13.2 kg) of grade 100/150 aluminum oxide abrasive mineral ($Al_2O_3$) (obtained from Washington Mills under the trade name Duralum).

The resulting spray coated web was dried in a 20 ft (6.1 m) long forced air convection oven at 350° F. (177° C.), with a residence time of about 4 minutes.

A second spray coat was applied to the first major surface of the web using spray nozzle #67 and a #67 cap (obtained from Midway Industrial Supply Co). This slurry was prepared by mixing 5.81 lb (2.64 kg) of propylene glycol monomethyl ether acetate (PM acetate) (obtained from Dow Chemical Co., Midland, Mich.), 7.29 lbs (3.31 kg) of a solution of 65% PM acetate and 35% MDA (4,4-methylene dianiline obtained from Aceto Corp., Lake Success, N.Y.), and 16.9 lbs (7.67 kg) of Adiprene BL-31 (obtained from Uniroyal Chemical Co., Middlebury, Conn.). This spray coat was applied in the manner described above to achieve a wet add-on of 80 grains/24 $in^2$ (334 g/m2). The resulting spray coated web was dried in the manner described above.

The finished dried web had a total weight of 616 grains/24 $in^2$ (2572 $g/m^2$).

The finished coated abrasive article of Example 1 resembled the abrasive article shown in FIG. 7, having connected peaks.

Example 2

Example 2 was prepared according to the procedure described in Example 1 except that the nonwoven web was turned over such that the first major surface was facing down as it was fed into the nip between the intermeshing patterned rollers. The resultant patterned nonwoven web was shaped such that there were raised portions or peaks formed on the first major surface. Each raised portion was about 3 mm high.

All subsequent coating operations were the same as outlined in Example 1.

The finished coated abrasive article of Example 2 resembled the abrasive article shown in FIG. 6, having individual peaks.

Example 3

Example 3 was prepared according to the procedure described in Example 1 except that the intermeshing pattern rollers were heated to 177° C. The resultant nonwoven web had less defined regions or pockets due to less thermoforming of the nonwoven fabric. The formed pocket was about 2-3 mm deep.

The finished coated abrasive article of Example 3 resembled the abrasive article shown in FIG. 7, having connected peaks.

Example 4

Example 4 was prepared according to the procedure described in Example 2 except that the intermeshing pattern rollers were heated to 177° C. The resultant nonwoven web had less defined raised portions or peaks due to less thermoforming of the nonwoven fabric. The formed raised portion was about 2 mm high.

The finished coated abrasive article of Example 4 resembled the abrasive article shown in FIG. 6, having individual peaks.

Example 5

This example was made as Example 3 except that a modified abrasive slurry was applied to the corrugated nonwoven web. The slurry was prepared by mixing together 8.49 lbs (3.85 kg) of phenolic resin (obtained from Neste Resins, Canada, under the trade designation BB077), 5.48 lbs (2.49 kg) water, 0.69 lbs (0.31 kg) of 75% hydroxyl ethyl ethylene urea in water (obtained from Sartomer Inc., under the trade designation SR511A) 2.39 lbs (1.08 kg) of potassium fluoroborate powder (obtained from Carter Day International, Minneapolis, Minn.), and 34.0 lbs (15.42 kg) of grade 80 aluminum oxide abrasive mineral ($Al_2O_3$) (obtained from Washington Mills under the trade name Duralam G52). This spray was applied and dried as described in Example 1. The slurry spray was applied such that a wet add-on weight of 333 grains/24 $in^2$ (1392 $g/m^2$) was achieved.

The finished coated abrasive article of Example 5 resembled the abrasive article shown in FIG. 7, having connected peaks.

Example 6

This example was prepared as Example 5 except that the nonwoven web was turned over such that the first major surface was facing down as it was fed into the nip between the intermeshing patterned rollers. The resultant patterned nonwoven web was shaped such that there were raised portions or peaks formed on the first major surface. Each raised portion was about 3 mm high. All subsequent coating operations were the same as outlined in Example 5.

The finished coated abrasive article of Example 6 resembled the abrasive article shown in FIG. 6, having individual peaks.

Comparative Example A

This comparative control example was made utilizing the needle-tacked nonwoven web as utilized in Examples 1-6, without the corrugation pattern. Coating methods and coating weights were the same as for Example 1.

Comparative Example B

This comparative control example was made utilizing the needle-tacked nonwoven web as utilized in Examples 5-6, but without the corrugation pattern. Coating methods and coating weights were the same as for Example 5.

Comparative Example C

This comparative example describes a disc that was pattern embossed after all web coating processes were completed. This example utilized the non-corrugated coated web as described in Comparative Example B. A 7 inch (17.8 cm) diameter disc was cut from the web described in Comparative Example B. Post embossing of this web was achieved by placing a perforated screen on top of the web, placing the web (with screen on top) between two platens heated to 340° F. (171° C.), and closing the platens for 20 seconds at a gauge pressure of 25 tons (22679 kg). The perforated screen was a 16 gauge (0.159 cm) 1008 cold rolled steel screen with 5/32 inch (0.397 cm) diameter holes on 7/32 inch (0.219 cm) centers. The resultant disc had raised portions on the disc face that were the same size and space as described by the perforated pattern screen.

Comparative Example D

This comparative example describes a disc that was pattern embossed after all web coating processes were completed. This example utilized the non-corrugated coated web as described in Comparative Example B. A 7 inch (17.8 cm) diameter disc was cut from the web described in comparative Example 2. Post embossing of this web was achieved by heating an aluminum bar (½ inch×¼ inch×10 inch) (1.27 cm×0.64 cm×25.4 cm) to 300° F. (149° C.). The ¼ inch face of the bar was then placed on top of the coated nonwoven disc such that the center of the bar passed through the center of the circular disc. The disc (with aluminum bar in place) was placed between platens heated to 300° F. (149° C.). The platens were closed for 6 seconds at a gauge pressure of 6 tons (5443 kg). This process was repeated 11 more times such that the finished embossed disc had 22 raised portions on the disc face separated one from another by 22 embossed regions extending radially from the center of the disc.

Comparative Example E

This comparative example describes a nonwoven disc that has ¼" (0.64 cm) diameter perforations placed within the outer annulus of the disc.

A 7 inch (17.78 cm) diameter nonwoven disc with no previous corrugation or embossed patterns (made as described in Comparative Example B) was utilized. This disc next had ¼ inch (0.64 cm) diameter holes cut into the disc utilizing a ¼ inch (0.64 cm) center hole punch and a hammer. The holes were punched such that three rows of perforations were placed in annular arrays on the disc. The outermost row contained 42 perforations on a diameter of about 6.38 inches (16.21 cm). The middle row contained 39 perforations on a diameter of about 5.50 inches (13.97 cm). The inner most row contained 32 perforations on a diameter of about 4.63 inches (11.76 cm). The resultant area of the disc that is presented to the test work piece has an open area of about 25%.

Test Method

The abrasive article Examples were evaluated against the Comparative Examples using the test described below.

A carbon steel bar (4 inches×18 inches×½ inch) (10.2 cm×46 cm×1.27 cm) was weighed and then secured to a workbench. A 7 inch (17.8 cm) diameter test specimen was mounted onto a right-angle compressed air tool (capable of rotating at 6000 rpm under zero load) via a 7 in. (17.8 cm) back-up pad (3M Disc Pad Face Plate, part no. 051144-80517, 3M Company, St. Paul, Minn.). The compressed air tool was activated, tilted to cause the test specimen to be heeled about 7 out of the plane defined by the flat bar and brought into abrasive contact with the bar by traversing the rotating test specimen along the bar's long dimension under no load other than that exerted by the weight of the tool itself (approx. 7 pounds (3.2 kg)). This abrasive action was maintained for 1 minute intervals. The weight of the bar was recorded following each interval. The total cut for 5 test intervals is reported.

| Disc Identification | Abrasive Grade | Cut (g) |
|---|---|---|
| Example 1 | 100/150 | 18.6 |
| Example 2 | 100/150 | 13.6 |
| Example 3 | 100/150 | 10.3 |
| Example 4 | 100/150 | 9.1 |
| Example 5 | 80 | 18.1 |
| Example 6 | 80 | 17.6 |
| Comparative A | 100/150 | 3.4 |
| Comparative B | 80 | 14 |
| Comparative C | 80 | 10.6 |
| Comparative D | 80 | 10.4 |
| Comparative E | 80 | 8.3 |

Various modifications and alterations of this invention will become apparent to those skilled in the art without departing from the scope and principles of this invention, and it should be understood that this invention is not to be unduly limited to the illustrative embodiments set forth hereinabove.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A nonwoven abrasive article comprising:

(a) a lofty nonwoven substrate having a first surface and an opposite second surface, the first surface and the second surface defining a plurality of peaks and valleys, wherein said peaks and said valleys are present as a rectilinear grid, the first surface and the second surface further defining a thickness, wherein the thickness varies by no more than 30% throughout the substrate; and (b) an abrasive coating comprising a hardened binder and abrasive particles dispersed throughout the binder, the abrasive coating being present on at least a portion of the first surface.

2. The nonwoven abrasive article according to claim 1, wherein the thickness of the substrate is at least 500 micrometers.

3. The nonwoven abrasive article according to claim 2, wherein the thickness of the substrate is at least 1 mm.

4. The nonwoven abrasive article according to claim 1, wherein the abrasive coating is present only on the peaks of the substrate.

5. The nonwoven abrasive article according to claim 1, wherein the abrasive coating is present only in the valleys of the substrate.

6. The nonwoven abrasive article according to claim 1, further comprising an abrasive coating comprising a binder and abrasive particles present on at least a portion of the second surface.

7. The nonwoven abrasive article according to claim 1, further comprising a second substrate attached to the second surface of the lofty nonwoven substrate.

8. The nonwoven abrasive article according to claim 7, wherein the second substrate comprises a sponge.

9. The nonwoven abrasive article according to claim 7, wherein the second substrate comprises a fabric.

10. The uouwoven abrasive article according to claim 1, wherein the abrasive particles have a particle size of at least 10 micrometers.

11. The nonwoven abrasive article according to claim 10, wherein the abrasive particles have a particle size of 50 to 600 micrometers.

12. The nonwoven abrasive article according to claim 1, wherein the peaks have a height of at least 0.5 mm.

13. The nonwoven abrasive article according to claim 1, having an overall thickness of at least 3 mm.

14. The nonwoven abrasive article according to claim 1, wherein a peak:valley area ratio is 75:25 to 25:75.

15. The nonwoven abrasive article according to claim 14, wherein the peak:valley area ratio is 50:50.

16. The nonwoven abrasive article according to claim 1, further comprising a reinforcing scrim.

17. The nonwoven abrasive article according to claim 16, wherein the reinforcing scrim is present between the first surface and the opposite second surface of the lofty nonwoven substrate.

18. A method of making a nonwoven abrasive article, the method comprising:

(a) providing a lofty nonwoven substrate having a first surface and an opposite second surface, the first surface and the second surface defining a plurality of peaks and valleys, wherein said peaks and said valleys are present as a rectilinear grid, the first surface and the second surface further defining a thickness, wherein the thickness varies by no more than 30% throughout the substrate; and (b) preparing an abrasive slurry comprising binder and abrasive particles; and (c) applying the abrasive slurry on at least a portion of the first surface of the lofty nonwoven substrate; and (d) curing the binder to form a hardened binder.

19. The method according to claim 18, further comprising:

(a) applying a size coat over the abrasive slurry.

20. The method according to claim 18, wherein the step of applying the abrasive slurry comprises:

(a) applying the abrasive slurry to the peaks and leaving the valleys uncoated.

21. The method according to claim 18, wherein the step of applying the abrasive slurry comprises:

(a) applying the abrasive slurry to the valleys and leaving the peaks uncoated.

22. The nonwoven abrasive article according to claim 1, wherein the thickness varies by no more than 20% throughout the substrate.

23. The method according to claim 18, wherein the thickness varies by not more than 20% throughout the substrate.

24. A nonwoven abrasive article comprising:

(a) a lofty nonwoven substrate having a first surface and an opposite second surface, the first surface and the second surface defining a plurality of peaks and valleys, wherein said peaks and said valleys are present as a rectilinear grid, the first surface and the second surface further defining a thickness, wherein the thickness varies by no more than 30% throughout the substrate; and (b) an abrasive coating comprising a hardened make coat and abrasive particles at least partially embedded in the hardened make coat present on at least a portion of the first surface; and (c) the abrasive coating comprising a size coat over the abrasive particles.

25. The nonwoven abrasive article according to claim 24, wherein the abrasive coating is present only on the peaks.

26. The nonwoven abrasive article according to claim 24, wherein the abrasive coating is present only in the valleys.

27. The nonwoven abrasive article according to claim 24, wherein the abrasive coating is present on the peaks and in the valleys.

28. The nonwoven abrasive article according to claim 24, wherein the peaks have a height of at least 0.5 mm.

29. The nonwoven abrasive article according to claim 24, wherein a peak:valley area ratio is 75:25 to 25:75.

30. The nonwoven abrasive article according to claim 1, wherein the abrasive coating is present on the peaks and in the valleys.

31. A nonwoven abrasive article comprising:

(a) a lofty nonwoven substrate having a first surface and an opposite second surface, the first surface and the second surface defining a plurality of peaks and valleys, wherein said peaks and said valleys are present as a rectilinear grid, the first surface and the second surface further defining a thickness, wherein the thickness varies by no more than 30% throughout the substrate; and (b) an abrasive coating comprising a binder and abrasive particles dispersed throughout the binder, (he abrasive coating being present only on the peaks of the substrate.

32. A nonwoven abrasive article comprising:

(a) a lofty nonwoven substrate having a first surface and an opposite second surface, the first surface and the second surface defining a plurality of peaks and valleys, wherein said peaks and said valleys are present as a rectilinear grid, the first surface and the second surface further defining a thickness, wherein the thickness varies by no more than 30% throughout the: substrate; and (b) an abrasive coating comprising a binder and abrasive particles dispersed throughout the binder, the abrasive coating being present only in the valleys of the substrate.

* * * * *

UNITED STATES PATENT AND TRADEMARK OFFICE

CERTIFICATE OF CORRECTION

PATENT NO. : 7,393,371 B2
APPLICATION NO. : 10/823136
DATED : July 1, 2008
INVENTOR(S) : Lucas M. O'Gary It is certified that error appears in the above-identified patent and that said Letters Patent is hereby corrected as shown below:

Column 5
Line 32, after "FIGS.", delete "2-7" and insert -- 2-7, -- therefor.

Column 13
Line 40, delete "7" and insert -- 7 degrees -- therefor.

Column 14
Line 42, In Claim 10, delete "uouwoven" and insert -- nonwoven -- therefor.

Column 16
Line 24, In Claim 31, after "binder", delete "(he" and insert -- the -- therefor.
Line 32, In Claim 32, delete "the:" and insert -- the -- therefor.

Signed and Sealed this

Thirteenth Day of January, 2009

JON W. DUDAS
*Director of the United States Patent and Trademark Office*